United States Patent [19]

Stanger et al.

[11] 4,192,572

[45] Mar. 11, 1980

[54] ELECTRICAL CONNECTOR APPARATUS

[75] Inventors: Robert J. Stanger, Alpha; Larry N. Siebens, Great Meadows, both of N.J.

[73] Assignee: Amerace Corporation, New York, N.Y.

[21] Appl. No.: 960,021

[22] Filed: Nov. 13, 1978

Related U.S. Application Data

[63] Continuation of Ser. No. 856,903, Dec. 2, 1977, abandoned, which is a continuation of Ser. No. 406,281, Oct. 15, 1973, abandoned.

[51] Int. Cl.[2] ..... H01R 13/52

[52] U.S. Cl. ..... 339/111; 200/144 C; 200/149 A; 339/46

[58] Field of Search ..... 339/111, 45, 46; 200/144 C, 149 A

[56] References Cited

U.S. PATENT DOCUMENTS

| | | | |
|---|---|---|---|
| 969,787 | 9/1910 | Leppert | 339/46 |
| 1,736,887 | 11/1929 | Pritchett | 339/46 |
| 3,542,986 | 11/1970 | Katski | 200/149 A |
| 3,792,215 | 2/1974 | Keto | 200/144 C |

*Primary Examiner*—Roy Lake
*Assistant Examiner*—DeWalden W. Jones
*Attorney, Agent, or Firm*—S. Michael Bender; Richard A. Craig

[57] ABSTRACT

Apparatus for connecting and disconnecting a male contact element and a high voltage cable includes a housing securable to the cable and defining an axial passage having a cavity, a piston assembly with a female contact element movable in the passage and defining a chamber, material generating arc-quenching gas, a gas-pressure responsive valve providing communication between the chamber and cavity selectively on fault closure to accelerate engagement of the contact elements and connectors for providing continuous electrical connection to the female contact element of substantially fixed resistivity.

51 Claims, 5 Drawing Figures

ELECTRICAL CONNECTOR APPARATUS

This is a continuation of application Ser. No. 856,903 filed Dec. 2, 1977, now abandoned, which is a continuation of application Ser. No. 406,281, filed Oct. 15, 1973now abandoned.

FIELD OF THE INVENTION

This invention relates generally to high voltage power distribution systems and more particularly to connector apparatus for providing separable interconnection of electrical cables of these systems.

BACKGROUND OF THE INVENTION

Three situations are typically encountered in the connection and disconnection of electrical connectors in power distribution systems. The so-called "loadmake" situation involves the joinder of male and female contact elements, one energized and the other engaged with a normal load. An arc of moderate intensity is struck between the contact elements as they approach one another and until joinder. The so-called "loadbreak" situation involves the separation of such mated male and female contact elements, while they supply power to a normal load. Moderate intensity arcing again occurs between the contact elements from the point of separation thereof until they are somewhat removed from one another. The so-called "fault closure" situation involves the joinder of male and female elements, one energized and the other engaged with a load having a fault, e.g., a short circuit condition. Quite substantial arcing occurs between the contact elements as they approach one another and until joinder, giving rise to the possibility of explosion and accompanying hazard to operating personnel.

Prior art efforts have reached a point wherein arcing in the loadmake and loadbreak situations is accommodated to more than a satisfactory extent. Thus, connector assemblies in widespread use employ materials which emit arc-quenching gas when subjected to arcing, thereby adequately dissipating the moderate intensity arcs occurring in these situations. Arcing in the loadbreak situation may be accommodated even further by connector assembly structure providing for operator movement of the contact elements, while mated, until the female contact element abuts against a stop member and the male contact element separates therefrom at high velocity as disclosed in U.S. Rueffer U.S. Pat. No. 3,259,726 and U.S. Kotski U.S. Pat. No. 3,542,986.

Devices not employing the above-mentioned high velocity contact separating structure for loadbreak accommodation, but suited for use in all three situations are shown in Ruete et al. U.S. Pat. No. 3,539,972 and Brown U.S. Pat. No. 3,654,590, commonly-assigned herewith.

As respects the fault closure situation, certain prior art efforts have looked to the use of the aforementioned arc-quenching gas for assistance in accelerating contact elements into engagement. While such prior art gas-assisted contact element engagement efforts have proved advantageous, need exists for continued improvement in connectors relying on arc-quenching gas-assistance in accommodating the fault closure situation through accelerated contact element engagement. Those prior art measures involving arc-quenching gas-assisted contact element movement are now discussed with particularity.

In U.S. Whitney Pat. No. 1,955,215 and in the above-mentioned Kotski U.S. Pat. No. 3,542,986, male and female contact elements having an arc-quenching guide in the latter patent, are joined in accelerated manner by the assistance of gas pressures attending arcing. In these efforts, an open-ended female contact element is supported by an open-ended piston movable in an axial passage in the connector housing. Arc-quenching gas is said to be conducted, without restriction, through the female contact element to exert net pressure on the piston. The piston and hence the female contact element are accordingly displaced in the direction of the male contact element, facilitating joinder more rapidly than would otherwise occur in the absence of such displacement. In freely conducting arc-quenching gas throughout the continuous volume of a female contact and a piston, these prior art efforts effect fault closure at the cost of less than desired loadbreak performance, since in loadbreak performance, it is desirable that the arc-quenching gas be restricted to a confined volume to facilitate containment of such conductive gas in the contact region upon contact separation.

In still another arrangement in present use and described in Joy Manufacturing Company Bulletin 215-4, January 1972, a connector housing includes an axial passage and fixedly supports therein a female contact element defining a chamber for receiving arc-quenching gas. The housing defines a cavity and includes a valve closing one end of the female contact element and thereby separating the female contact element chamber from the housing cavity. A piston disposed in the housing passage encircles the fixed female contact element and is in sliding engagement therewith. The piston supports an arc-quenching guide and a ring-shaped contact element for joint movement therewith. The ring-shaped contact element engages the male contact element on its insertion in the housing at a time prior to joinder thereof with the fixed female contact element. Arc-quenching gas generated by the arc struck between such ring contact and the male contact element during fault closure is conducted into the fixed female contact element chamber and operates the valve, the gas thereupon entering the cavity and moving the piston toward the male contact element. Prior to ultimate engagement of the male and female contact elements, fault current flows through the ring-shaped contact element and is transferred to the female contact element through sliding frictional engagement thereof with the piston. This arrangement is less than desirable in that circuit resistance varies widely during fault closure due to its dependence on indeterminate sliding frictional engagement between the piston and the female contact element surfaces. Furthermore, since the female contact element is fixed in the housing, and since the ring-shaped contact element does not frictionally engage the male contact element, this Joy device does not involve the aforementioned Rueffer patent loadbreak assist, and accordingly effects accelerated fault closure at the cost of less than desired loadbreak performance.

SUMMARY OF THE INVENTION

An object of the present invention is to provide connector apparatus for use in loadmake, loadbreak and fault closure situations and which is adaptive in its operation to individually serve the needs of each situation.

Toward the attainment of this and other objects, the invention provides connector apparatus incorporating a housing having opposed ends and an axial passage therebetween, means defining a cavity in said passage, a piston assembly disposed in said passage and comprising an arc-quenching guide, a female contact element having a chamber into which arc-quenching gas is directed, a piston supporting the guide and the female contact element for joint movement and gas-pressure responsive valve means for separating the female contact element and the housing cavity and operable to selectively move the piston assembly to accelerate contact element joinder in fault closure situations, and means providing continuous electrical connection to the female contact element of substantially fixed resistivity.

As contrasted with the various functional capabilities provided separately or in limited groupings in the prior art connector apparatus discussed above, the above-summarized and other apparatus according with the invention provides these and other capabilities compositively. Such apparatus provides for preselected positioning of its movable female contact element for assisting loadmake, a degree of freedom of movement for said female contact element for movement thereof while mated with a male connector and gas confinement capacity in said female contact element to enhance loadbreak, and selective gas-assisted movement of said female contact element while providing invariant electrical continuity thereto, thus facilitating fault closure.

The foregoing and other objects and features of the invention will be evident from the following detailed discussion of preferred embodiments thereof and from the drawings wherein like reference numerals identify like parts throughout.

DESCRIPTION OF PREFERRED EMBODIMENTS

Figure 1:
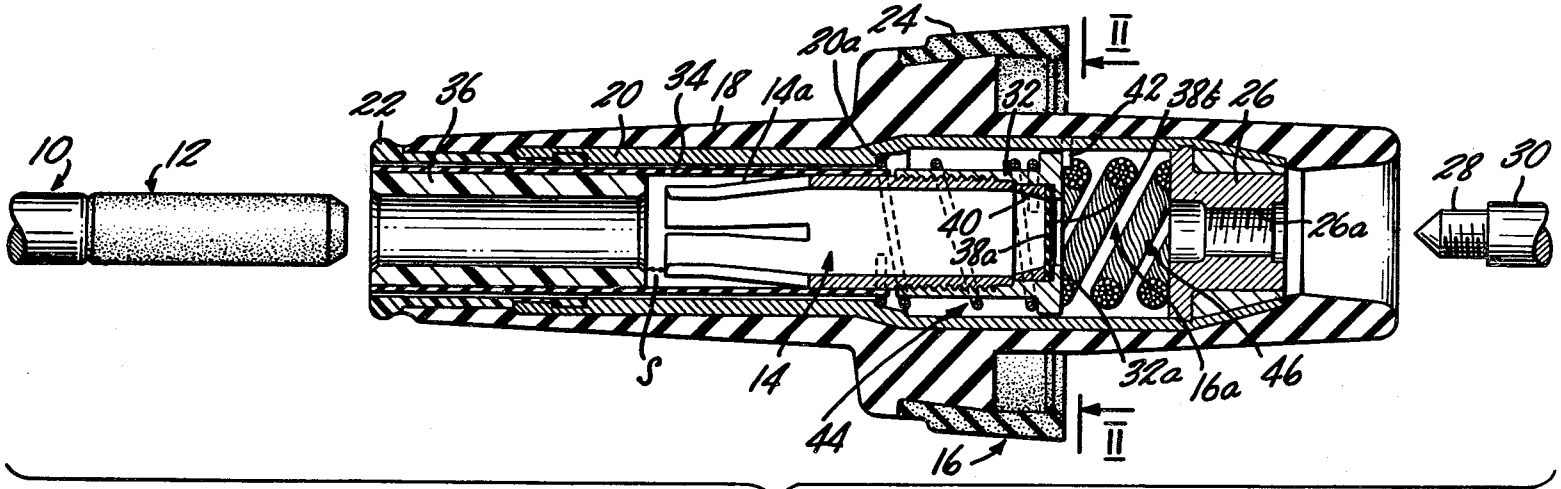
FIG. 1 is a side elevation in full cross-section of connector apparatus in accordance with the invention, shown with a male contact element and high voltage cable separably connected thereby.
Figure 2:
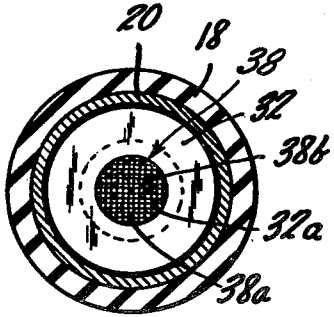
FIG. 2 is a view taken along line II—II of FIG. 1, illustrating one type of valve employable in practicing the invention.

Referring to FIGS. 1 and 2 pin-shaped male contact element 10 is connected through a suitable connector housing to a high voltage electrical conductor (not shown) and supports a follower 12 fabricated of a material suitable for evolving or generating an arc-quenching gas upon being subjected to arcing. A female contact element 14 includes resilient fingers 14a for facilitating gripping joinder thereof with contact element 10, attainable following insertion of follower 12 into composite housing 16. Housing 16 defines an axial opening or passage between its opposed ends and includes an outer member or casing 18 preferably formed of elastomeric insulative material, an inner member or sleeve 20 and an insulative insert 22 interlatched with sleeve 20 as shown. Sleeve 20 is comprised of rigid conductive material, e.g., aluminum, and defines a region of uniform electrical potential interiorly of casing 18. Casing 18 may include a sleeve 24 preferably of conductive elastomeric material molded to the exterior of the casing as generally indicated for establishing a shield at the same electrical potential as supporting structure, such as a wall of a transformer casing, for example. Conductive base 26 is seated in one end of the housing axial passage and comprises a conductive insert equipped with a threaded bore 26a or the like for receiving the threaded extension 28 of an electrical cable 30 comprising, for example, a lead-in connection to a winding of such transformer. On engagement thereof, base 26 and cable extension 28 effectively close one end of the housing passage.

A piston or female contact assembly is disposed in the housing passage for sliding displacement and comprises an electrically conductive piston 32, female contact element 14, a tubular insulative sleeve 34, guide 36 and valve 38. In the illustrated construction of the piston assembly, piston 32 includes a through bore interiorly threaded in part and female contact element 14 is threaded exteriorly for fixed securement in the piston bore. Tubular sleeve 34 is secured, e.g., by an adhesive, to female contact element 14 and in turn encirclingly supports guide 36 through the use of a like adhesive. By this arrangement all elements of the piston or female contact assembly are jointly movable.

Guide 36 is comprised of arc-quenching material, preferably, though not necessarily, the same as that of the follower 12, and functions to receive and guide follower 12 and contact element 10 and to provide mutual alignment of the FIG. 1 apparatus and the housing (not shown) for male contact element 10.

Figure 5:
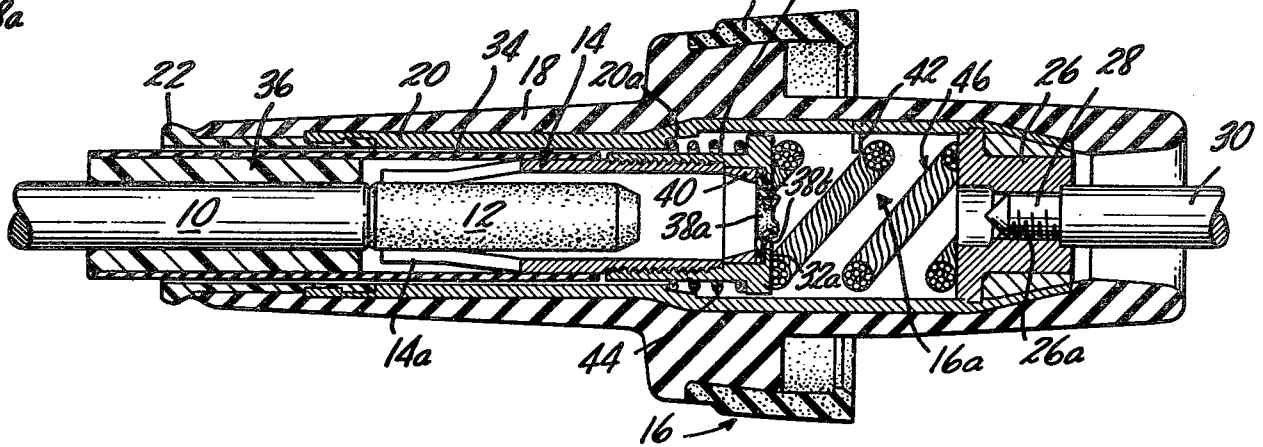
FIG. 5 illustrates the state of the FIG. 1 apparatus during the course of fault closure activity.

Valve 38 is seated in the piston bore against centrally apertured piston wall 32a and is held securely in place by ring 40 against which bears one end of contact element 14. One form of valve suitable for use in practicing the invention is shown in FIGS. 1 and 2, the detail thereof being best seen in FIG. 2 wherein rupturable resilient member or disc 38a and wire screen 38b provide a closed or substantially gas-impermeable structure when the differential in gas pressure thereacross is less than a predetermined gas pressure differential. In response to differential pressure equal to or exceeding such predetermined differential, the valve is ruptured as shown in FIG. 5. As discussed below, such predetermined gas pressure differential is that occurring upon fault closure activity. Screen 38b reinforces member 38a to avert rupture at gas pressure differentials lower than said predetermined pressure differential.

Pin 42 is supported by housing 16 axially spaced from base 26 and projects into the housing passage for defining a chamber or cavity 16a of no lesser axial extent than such spacing.

In the position thereof illustrated in FIG. 1, piston 32 abuts pin 42 under the influence of biasing or resilient means, preferably comprising a compression spring 44. Sleeve 20 includes an expanse of increased diameter defining a shoulder 20a for seating one end of the spring. The other end of the spring bears against piston 32. Pin 42 thus functions as a stop or limiting means, preventing displacement of the piston assembly into the above-mentioned axial cavity. Under these conditions, tubular sleeve 34 is disposed in a first position wherein piston 32 is substantially adjacent the end of the housing seating base 26.

The piston assembly defines an axial chamber inclusive of the interior hollows of guide 36, sleeve 34 and female contact element 14, such chamber being isolated from the above-mentioned housing chamber or axial cavity when valve 38 is closed.

Conductors or connectors 46 are disposed in such cavity and the ends of the cable are secured respectively to base 26 and piston 32. Conductors 46 provide electrical continuity of substantially fixed resistivity between piston 32 and base 26 and accordingly between female contact element 14 and cable 30.

Characteristics of the FIG. 1 apparatus other than those elicited in the foregoing discussion will be evident from the following description of the operation of such structure respectively in loadmake, loadbreak, and fault closure activity.

Loadmake

With the component parts of the apparatus in position illustrated in FIG. 1, follower 12 is inserted into guide 36. Spring 44 normally maintains sleeve 34 and piston 32 in the above-mentioned first position. With the piston in such easily recognized and certain position and upon abutment between follower 12 and resilient fingers **14*a*, alignment of the male contact element housing with the female contact element housing as well as operator stance may be checked for any necessary correction. Upon continued insertion of follower 12, resilient fingers 14*a* are spread and frictionally engage the follower periphery. In the course of such continued insertion, an arc is struck prior to engagement of fingers 14*a* with contact element 10. Under normal load conditions in the circuit connected to cable 30, the energy of such arc is moderate. During the course of arcing, guide 36 and follower 12 emit arc-quenching gas. The arc may persist at intensity lessened by the quenching gas until fingers 14*a* engage contact element 10. Throughout persistence of the arc, all arcing current flows through a definite electrical path of substantially fixed resistivity between cable 30 and its unshown counterpart cable, such path comprising pin 10, contact element 14, piston 32, cables 46 and base 26. Under such loadmake conditions valve 38 isolates cavity 16*a*** from the piston assembly chamber and is effective to confine arc-quenching gas to the region of the arc.

Figure 3:
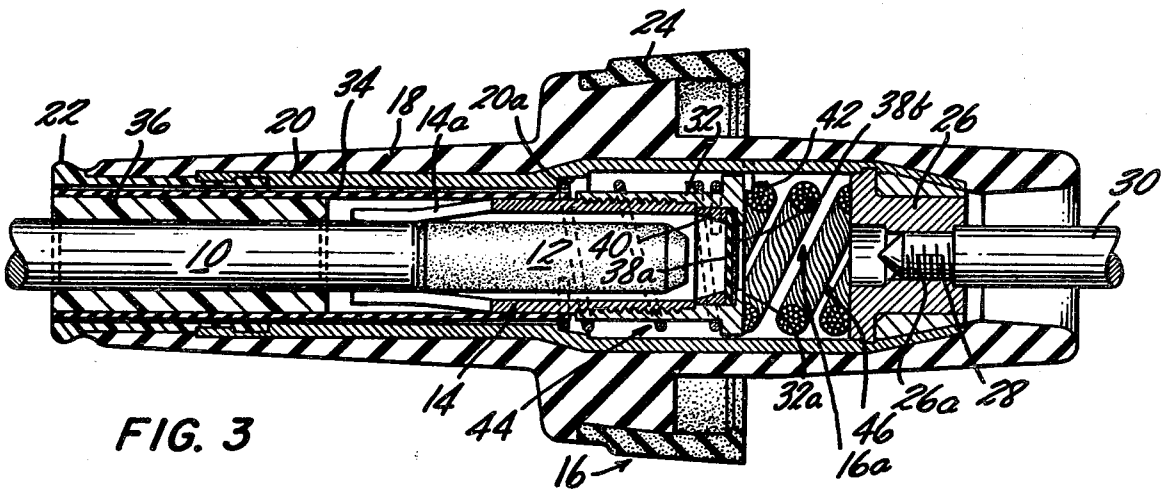
FIG. 3 illustrates the state of the FIG. 1 apparatus in completed loadmake activity.

FIG. 3 shows the connector apparatus on completion of loadmake and in its principal usage, i.e., in energizing a load.

Loadbreak

Figure 4:
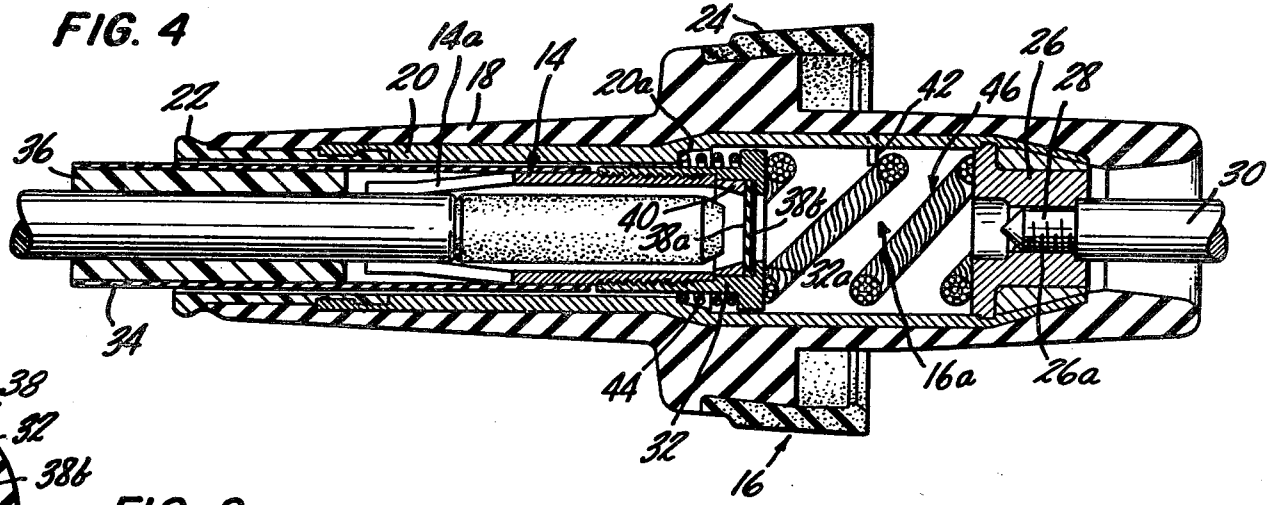
FIG. 4 illustrates the state of the FIG. 1 apparatus immediately prior to loadbreak activity.

In the event it is necessary or desirable to interrupt electrical continuity between contact element 10 and cable 30 while the circuit is energized, element 10 is withdrawn from housing 16. Since contact fingers **14*a* apply a frictional force to element 10 exceeding the force applied by spring 44 to piston 32, the piston assembly is withdrawn jointly with element 10, i.e., sleeve 34, element 14 and element 10 move jointly, up to the point at which shoulder 20*a* and then compressed spring 44 limit piston assembly movement in the direction of withdrawal as shown in FIG. 4. Sleeve 34 is thus in a second position wherein the piston is located between its first position and the end of the housing receiving element 10. At this juncture, element 10 moves relative to the piston assembly and ultimately separates from contact element fingers 14*a* at which time an arc is struck therebetween. Such arc is quenched by gases generated by guide 36 and follower 12 and is ultimately extinguished as the contact elements further separate and the follower thereafter exits from guide 36. Arc extinction is abetted since element 10 not only exits from contact element 14 at substantially the speed of movement imparted thereto by the operator but furthermore since tubular sleeve 34, hence contact element 14, is itself rapidly returned to its normal first position upon disengagement from element 10 and follower 12 under the influence of spring 44, thereby facilitating accelerated separation of these contact elements. Such rapid return preferably commences when the follower 12 is partially withdrawn from female contact element 14. In order to facilitate the foregoing, the pin follower 12 may be slightly tapered along its axial extent. It will be understood that initial joint movement of the contact elements and subsequent relative sliding movement therebetween may occur during withdrawal of the male contact element before spring 44** is fully compressed.

While valve 38 is inoperable during the above-discussed loadbreak situation, its presence nevertheless contributes substantially to the loadbreak performance of a connector assembly having capacity for gas-accelerated contact engagement during fault closure, as will be discussed after the following explanation of fault closure activity.

Fault Closure

To the extent that an operator is unaware of the existence of a fault condition in a load, he approaches this situation, as in the loadmake situation above-discussed, by inserting follower 12 in guide 36 and checking stance, alignment and like considerations. The follower is then inserted within contact element fingers **14*a* and, as element 10 approaches the fingers, an arc of quite high intensity is struck, producing a shock wave in the piston assembly chamber and thereby creating said predetermined pressure differential across valve 38. Valve 38 is accordingly ruptured. On this event arc-quenching gas passes from the piston assembly chamber, through the ruptured valve and into cavity 16*a* and exerts a net force on piston 32 displacing the same toward element 10 as shown in FIG. 5. Accordingly, contact element fingers 14*a* are accelerated into engagement with element 10**, extinguishing the arc.

In providing, in a composite structure, performance capabilities approached separately or in limited groupings in presently-used connector apparatus, the apparatus of the invention gains certain performance benefits. By way of example alluded to above, valve 38, operable exclusively in fault closure activity, abets loadbreak performance although then inoperable. Fundamental to such fault closure activity is the requirement for a housing cavity located on the side of a piston assembly opposite that side thereof toward which the male contact element is advanced. Such cavity constitutes gas-accessible volume additive to that of the piston assembly chamber. In the course of loadbreak, however, such additive gas-accessible volume is undesired since it is believed that the same lessens the vacuum created within the housing upon withdrawal of the male contact element. The level of such created vacuum controls the inrush of air which counteracts arc-generated gas and prevents the same from flushing out between the separated housings and forming an undesirable conductive path to ground. A desired higher vacuum level during loadbreak in a connector also adapted for fault closure is attained in substantial part by means such as valve 38.

A particularly desired feature which may be introduced in connectors according with the invention for purposes of minimizing arcing and decreasing the gas generated by arcing during fault closure involves the spacing of contact element 14 from guide 36 by an axial length no less than the order of magnitude of one-half the distance between contact elements 10 and 14 at which an arc will be struck between the contact elements as contact element 10 approaches contact element 14 under high voltage fault conditions. Such spacing is indicated in FIG. 1 by the reference designation S.

Various alternative valve constructions may be employed in place of the preferred rupturable valve. Thus, for example, the invention contemplates use of a duckbill flap type of valve which opens upon fault closure and reverts to its substantially gas impermeable initial condition following fault closure activity, i.e., a reclosable valve means.

Various additional changes to the particularly disclosed and illustrated connector apparatus and modifications in the practice outlined above will now be evident to those skilled in the art. The particularly discussed embodiment of connector apparatus according with the invention is accordingly to be considered illustrative and not limiting. The true spirit and scope of the invention is set forth in the following claims.

What is claimed is:

1. A separable female connector for use in connecting or disconnecting an energized high voltage circuit by engagement or disengagement with a complementary connector having a male contact element, said female connector comprising:

a housing, said housing having first and second ends and an axially extending opening therebetween, a female contact assembly in said housing opening, said assembly including (a) a tubular sleeve having piston means at one end thereof for defining a first chamber within said tubular sleeve, (b) female contact means fixedly positioned with respect to said tubular sleeve in said first chamber for engaging said male contact element, said female contact means being electrically connected to said piston means, (c) guide means at the other end of said tubular sleeve for receiving and guiding said male contact element for movement within said first chamber, and for evolving arc-quenching gas in response to an arc being struck between said male contact element and said female contact means during said movement, said tubular sleeve being mounted in said housing opening for axial movement between a first position wherein said piston means is substantially adjacent to said second end of said housing and a second position wherein said piston means is located between its said first position and said first end of said housing, said housing opening defining a second chamber, said female contact assembly further including (d) valve means responsive to arc-quenching gas of predetermined pressure in said first chamber to provide a passage from said first chamber to said second chamber for applying said gas to said piston means thereby displacing said tubular sleeve from said first position to said second position and accelerating engagement of said female contact means with said male contact element to extinguish said arc, biasing means between said housing and said tubular sleeve for normally maintaining said tubular sleeve in said first position, for permitting joint movement of said male contact element and said tubular sleeve between said first position and said second position during withdrawal of said male contact element from said connector, and for accelerating the return of said tubular sleeve to said first position upon disengagement of said male contact element from said female contact means, terminal means in said second end of said housing adapted for connection in a high voltage circuit, and conductor means disposed interiorly of said second chamber between said second end of said housing and said piston means for electrically connecting said piston means and said terminal means.

2. The female connector claimed in claim 1 wherein said guide means is axially spaced from said female contact means by no less than the order of magnitude of one-half the distance between said male contact element and said female contact means at which an arc will be struck between said male contact element and said female contact means as said male contact element approaches said female contact means under high voltage fault conditions.

3. The female connector claimed in claim 1 wherein said female contact means defines an axial bore communicating with said piston means and therewith defining said first chamber, whereby said female contact means confines said arc-quenching gas where said arc-quenching gas is at pressure less than said predetermined pressure.

4. The female connector claimed in claim 1 wherein said valve means is rupturable to provide said passage from said first chamber to said second chamber.

5. The female connector claimed in claim 1 wherein said valve means is opened when said arc-quenching gas is at pressure equal to or greater than said predetermined pressure and is closed when said arc-quenching gas is at pressure less than said predetermined pressure.

6. The female connector claimed in claim 1 wherein said housing comprises an outer member of elastomeric insulative material and an inner member of conductive material contiguous with said outer member throughout the axial extent of said inner member.

7. The female connector claimed in claim 6 wherein said inner member is a rigid metallic member.

8. The female connector claimed in claim 7 wherein said rigid metallic member is comprised of aluminum.

9. An assembly for electrically connecting and disconnecting a high voltage cable and a male contact element, comprising:

(a) a housing having first and second ends and an axial passage therebetween;

(b) conductive base means seated in said housing first end and engageable with said cable for closing said housing first end;

(c) a piston assembly slidably displaceable in said passage and having an axial chamber;

(d) first means fixedly supported in said housing for limiting displacement of said piston assembly therebeyond toward said housing first end and axially spaced from said base means for defining a cavity in said housing passage;

(e) second means fixedly supported in said housing between said first means and said housing second end for limiting displacement of said piston assembly therebeyond toward said housing second end; said piston assembly including (c1) a female contact element having resilient contact fingers for engaging said male contact element, (c2) guide means for guiding said male contact element into said axial chamber and for generating arc-quenching gas therein upon arcing between said contact elements, (c3) a tubular member supporting said guide means, (c4) a conductive piston connected to said female contact element and supporting the same in fixed relation to said tubular member, and (c5) valve means for separating said cavity and said chamber, and (f) connector means for providing electrical continuity of substantially fixed resistivity between said piston and said base means, said valve means being operable on movement of said male contact element through said guide means toward said housing first end to conduct arc-quenching gas from said chamber into said cavity exclusively upon predetermined arc-quenching gas pressure in said chamber, thereby displacing said piston assembly toward said housing second end and accelerating engagement of said contact fingers and said male contact element, said contact fingers maintaining such engagement with said male contact element during subsequent movement of said male contact element toward said housing second end until displacement of said piston assembly is limited by said second means, said contact fingers thereupon releasing said male contact element at substantially the speed of movement thereof.

10. The assembly claimed in claim 9 wherein said guide means is axially spaced from said female contact element by no less than the order of magnitude of one-half the distance between said male contact element and said female contact element at which an arc will be struck between said male contact element and said female contact element as said male contact element approaches said female contact element under high voltage fault conditions.

11. The assembly claimed in claim 9 wherein said female contact element defines an axial bore communicating with said piston and therewith defining said chamber, said female contact element confining said arc-quenching gas where said arc-quenching gas is at pressure less than said predetermined pressure.

12. The assembly claimed in claim 9 wherein said valve means is rupturable to provide said passage from said chamber to said cavity.

13. The assembly claimed in claim 9 wherein said valve means is openable when said arc-quenching gas is at pressure equal to or greater than said predetermined pressure and is closable when said arc-quenching gas is at pressure less than said predetermined pressure.

14. The assembly claimed in claim 9 wherein said housing comprises an outer member of elastomeric insulative material and an inner member of conductive material contiguous with said outer member throughout the axial extent of said inner member.

15. The assembly claimed in claim 14 wherein said inner member is a rigid metallic member.

16. The assembly claimed in claim 15 wherein said rigid metallic member is comprised of aluminum.

17. An assembly for electrically connecting and disconnecting a high voltage cable and a male contact element, comprising:

(a) a housing having first and second ends and an axial passage therebetween;

(b) conductive base means seated in said housing first end and engageable with said cable for closing said housing first end;

(c) a piston assembly slidably displaceable in said passage and having an axial chamber;

(d) first means fixedly supported in said housing for limiting displacement of said piston assembly therebeyond toward said housing first end and axially spaced from said base means for defining a cavity in said housing passage;

(e) second means fixedly supported in said housing between said first means and said housing second end for limiting displacement of said piston assembly therebeyond toward said housing second end, said second means biasing said piston assembly into engagement with said first means; said piston assembly including (c1) a female contact element having resilient contact fingers for engaging said male contact element, (c2) guide means for guiding said male contact element into said axial chamber and for generating arc-quenching gas therein upon arcing between said contact elements, (c3) a tubular member supporting said guide means, (c4) a conductive piston connected to said female contact element and supporting the same in fixed relation to said tubular member, and (c5) valve means for separating said cavity and said chamber, and (f) connector means for providing electrical continuity of substantially fixed resistivity between said piston and said base means, said valve means being operable on movement of said male contact element through said guide means toward said housing first end to conduct arc-quenching gas from said chamber into said cavity exclusively upon predetermined arc-quenching gas pressure in said chamber, thereby displacing said piston assembly from said biased engagement thereof with said first means toward said housing second end and accelerating engagement of said contact fingers and said male contact element, said contact fingers maintaining such engagement with said male contact element during subsequent movement of said male contact element toward said housing second end until displacement of said piston assembly is limited by said second means, said contact fingers thereupon releasing said male contact element at substantially the speed of movement thereof, said second means thereupon returning said piston assembly into said biased engagement thereof with said first means.

18. The assembly claimed in claim 17 wherein said guide means is axially spaced from said female contact element by no less than the order of magnitude of one-half the distance between said male contact element and said female contact element at which an arc will be struck between said male contact element and said female contact element as said male contact element approaches said female contact element under high voltage fault conditions.

19. The assembly claimed in claim 17 wherein said female contact element defines an axial bore communicating with said piston and therewith defining said chamber, said female contact element confining said arc-quenching gas where said arc-quenching gas is at pressure less than said predetermined pressure.

20. The assembly claimed in claim 17 wherein said valve means is rupturable to provide said passage from said chamber to said cavity.

21. The assembly claimed in claim 17 wherein said valve means is openable when said arc-quenching gas is at pressure equal to or greater than said predetermined pressure and is closable when said arc-quenching gas is at pressure less than said predetermined pressure.

22. The assembly claimed in claim 17 wherein said housing comprises an outer member of elastomeric insulative material and an inner member of conductive material contiguous with said outer member throughout the axial extent of said inner member.

23. The assembly claimed in claim 22 wherein said inner member is a rigid metallic member.

24. The assembly claimed in claim 23 wherein said rigid metallic member is comprised of aluminum.

25. A separable female connector for use in connecting or disconnecting an energized high voltage circuit by engagement or disengagement with a complementary connector having a male contact element, said female connector comprising:

a housing, said housing having first and second ends and an axially extending opening therebetween, a female contact assembly mounted for axial movement in said housing opening, said assembly including (a) a tubular sleeve having piston means at one end thereof for defining a first chamber within said tubular sleeve, (b) female contact means fixedly positioned with respect to said tubular sleeve in said first chamber for engaging said male contact element, said female contact means being electrically connected to said piston means, (c) guide means at the other end of said tubular sleeve for receiving and guiding said male contact element for movement within said first chamber, and for evolving arc-quenching gas in response to an arc being struck between said male contact element and said female contact means during said movement, said housing opening defining a second chamber, said female contact assembly further including (d) valve means responsive to arc-quenching gas of predetermined pressure in said first chamber to provide a passage from said first chamber to said second chamber for applying said gas to said piston means thereby displacing said female contact assembly and accelerating engagement of said female contact means with said male contact element to extinguish said arc, terminal means in said second end of said housing adapted for connection in a high voltage circuit, and conductor means disposed interiorly of said second chamber between said second end of said housing and said piston means for electrically connecting said piston means and said terminal means.

26. The female connector claimed in claim 25 wherein said guide means is axially spaced from said female contact means by no less than the order of magnitude of one-half the distance between said male contact element and said female contact means at which an arc will be struck between said male contact element and said female contact means as said male contact element approaches said female contact means under high voltage fault conditions.

27. The female connector claimed in claim 26 wherein said female contact means defines an axial bore communicating with said piston means and therewith defining said first chamber, whereby said female contact means confines said arc-quenching gas where said arc-quenching gas is at pressure less than said predetermined pressure.

28. The female connector claimed in claim 26 wherein said valve means is rupturable to provide said passage from said first chamber to said second chamber.

29. The female connector claimed in claim 26 wherein said valve means is opened when said arc-quenching gas is at pressure equal to or greater than said predetermined pressure and is closed when said arc-quenching gas is at pressure less than said predetermined pressure.

30. The female connector claimed in claim 26 wherein said housing comprises an outer member of elastomeric insulative material and an inner member of conductive material contiguous with said outer member throughout the axial extent of said inner member.

31. The female connector claimed in claim 30 wherein said inner member is a rigid metallic member.

32. The female connector claimed in claim 31 wherein said rigid metallic member is comprised of aluminum.

33. The female connector claimed in claim 26 wherein said piston includes an axial bore and wherein said valve means comprises a rupturable disc and reinforcing means disposed in said piston axial bore.

34. A female connector for use in connecting a male contact element with an energized high voltage circuit, said connector comprising:

a housing having a first end adapted to receive said male contact element, a second end adapted to be substantially closed and an axially extending opening therebetween, an elongate female contact assembly in said housing opening, said assembly including (a) a tubular sleeve having piston means, said sleeve being axially movable between a first position wherein said piston means is maximally spaced from said first housing end and a second position wherein said piston means is minimally spaced from said first housing end, said piston means providing said assembly with a first chamber remote from said second housing end and a second chamber adjacent said second housing end, (b) female contact means in said first chamber for engaging said male contact element, said female contact means being carried by and movable with and in electrically conductive relationship with said sleeve, (c) means for evolving arc-quenching gas in said first chamber in response to an arc being struck between said male contact element and said female contact means as said male contact element approaches said female contact means, and (d) means for maintaining said sleeve in said first position until the gas pressure of such evolved arc-quenching gas attains a predetermined value and for permitting said sleeve to move toward said second position when said pressure exceeds said predetermined value, under the influence of gas pressure exerted on said piston means in said second chamber.

35. The connector claimed in claim 34 wherein said sleeve and said female contact means are separate parts.

36. The connector claimed in claim 34 wherein a valve is situated between said first and second chambers, said valve being normally closed but openable to permit flow of gas from said first chamber to said second chamber.

37. The connector claimed in claim 36 wherein said means for maintaining said sleeve in said first position comprises said valve.

38. The connector claimed in claim 37 wherein said piston means has a closed wall at an end thereof adjacent said second housing end and said valve is in said wall.

39. The connector claimed in claim 37 wherein said valve comprises a disc rupturable at said predetermined pressure.

40. The connector claimed in claim 36 wherein said valve is reclosable.

41. The connector claimed in claim 37 wherein said maintaining means further comprises means resiliently biasing said sleeve in said first position.

42. The connector claimed in claim 41 wherein said biasing means is a spring.

43. A female connector for use in connecting a male contact element with an energized high voltage circuit, said connector comprising:

a housing having a first end adapted to receive said male contact element, a second end adapted to be substantially closed and an axially extending opening therebetween, an elongate female contact assembly in said housing opening, said assembly including (a) a tubular sleeve having piston means, said sleeve being axially movable between a first position wherein said piston means is maximally spaced from said first housing end and a second position wherein said piston means is minimally spaced from said first housing end, (b) female contact means for engaging said male contact element, said female contact means being carried by and movable with said sleeve, (c) means for evolving arc-quenching gas in response to an arc being struck between said male contact element and said female contact means as said male contact element approaches said female contact means, and (d) means for maintaining said sleeve in said first position until the gas pressure of such evolved arc-quenching gas attains a predetermined value and for permitting said sleeve to move toward said second position when said pressure exceeds said predetermined value, under the influence of gas pressure exerted on said piston means.

44. The connector claimed in claim 43 wherein said assembly has a first chamber remote from said second housing end and a second chamber adjacent said second housing end, said female contact means is in said first chamber and in electrically conductive relationship with said sleeve, said means for evolving arc-quenching gas is in said first chamber and said gas pressure which is exerted on said piston means is provided by gas in said second chamber.

45. In a female connector for use in connecting a male contact element with an energized high voltage circuit, said connector comprising a housing having a first end adapted to receive said male contact element, a second end adapted to be substantially closed and an axially extending opening therebetween and an elongate female contact assembly in said housing opening, said assembly including a tubular sleeve having piston means, said sleeve being axially movable between a first position wherein said piston means is maximally spaced from said first housing end and a second position wherein said piston means is minimally spaced from said first housing end, female contact means for engaging said male contact element, said female contact means being carried by and movable with said sleeve, and means for evolving arc-quenching gas in response to an arc being struck between said male contact element and said female contact means as said male contact element approaches said female contact means:

the improvement comprising means for maintaining said sleeve in said first position until the gas pressure of such evolved arc-quenching gas attains a predetermined value and for permitting said sleeve to move toward said second position when said pressure exceeds said predetermined value, under the influence of gas pressure exerted on said piston means.

46. The connector claimed in claim 44 wherein said assembly has means providing communication between said first and second chambers.

47. The connector claimed in claim 46 wherein said communication providing means comprises a valve.

48. The connector claimed in claim 46 wherein said means for maintaining said sleeve in said first position comprises a valve.

49. The connector claimed in claim 48 wherein said maintaining means further comprises means resiliently biasing said sleeve in said first position.

50. The connector claimed in claim 47 wherein said means for maintaining said sleeve in said first position comprises said valve.

51. The connector claimed in claim 50 wherein said maintaining means further comprises means resiliently biasing said sleeve in said first position.

* * * * *